US005829093A

United States Patent [19]

Kim

[11] Patent Number: 5,829,093

[45] Date of Patent: Nov. 3, 1998

[54] INDICATOR DEVICE FOR A VACUUM CLEANER DUST CONTAINER

[75] Inventor: Suk-Gu Kim, Seoul, Rep. of Korea

[73] Assignee: Daewoo Electronics Co., Ltd., Seoul, Rep. of Korea

[21] Appl. No.: 738,869

[22] Filed: Oct. 28, 1996

[30] Foreign Application Priority Data

Oct. 31, 1995 [KR] Rep. of Korea ..... 1995 38630

[51] Int. Cl.[6] ..... A47L 9/00

[52] U.S. Cl. ..... 15/339; 116/271; 116/276

[58] Field of Search ..... 15/339; 116/268, 116/271, 274, 276, DIG. 25

[56] References Cited

U.S. PATENT DOCUMENTS 4,060,050 11/1977 Simonsson ..... 15/339

*Primary Examiner*—Diana Biefeld

*Attorney, Agent, or Firm*—Beveridge, DeGrandi, Weilacher & Young, L.L.P.

[57] ABSTRACT

Disclosed is an indicator device for visually denoting the amount of filled dust in a dust container of a vacuum cleaner. The indicator device operates based on a vacuum pressure difference created between an air suction port and an outlet of the vacuum cleaner. When a vacuum pressure difference is created between the air suction port and the outlet of the vacuum cleaner, a disc-shaped colored film and a circular rotating member positioned in an upper cap of the indicator device receive an atmosphere air from the exterior of the indicator device and denotes the amount of dust filled in the dust container. For this purpose, a colored film is separated by 3×N (N is an integer) times and colored in three primary colors of light of red, green and blue or in three primary colors of red, yellow and blue. The user of the vacuum cleaner can notice the operating state of the vacuum cleaner or the replacement time of the dust container by observing the color change of the colored film through the transparent upper surface of the upper cap installed at a through groove formed at the hood of the vacuum cleaner and exposed to the outside of the vacuum cleaner.

26 Claims, 8 Drawing Sheets

INDICATOR DEVICE FOR A VACUUM CLEANER DUST CONTAINER

BACKGROUND OF THE INVENTION

1. Field of the Invention

The present invention relates to an indicator device for a vacuum cleaner dust container, and more particularly to an indicator device for a vacuum cleaner dust container having a simple internal structure and a low manufacturing cost.

2. Description of the Prior Art

Generally, a vacuum cleaner is provided with a disposable dust container for receiving a certain amount of dust collected by the vacuum cleaner. The dust container storing dust sucked into the vacuum cleaner should be replaced by a new dust container when the dust container is filled with dust. If the dust container filled with dust is not replaced by a new dust container in a timely manner, the function of the vacuum cleaner will deteriorate. That is, when an excessive amount of dust is collected in the dust container, the flow of the sucked air into the vacuum cleaner will meet a quite strong resistance. This may result in an over-loading of the driving motor of the vacuum cleaner and further, may destroy the driving motor. For preventing the above-mentioned results, an indicator device for a vacuum cleaner for notifying the user of the replacing time of the dust container has been developed.

Until now, various kinds of indicator devices for a vacuum cleaner have been suggested. Generally, the indicator devices let the user of the vacuum cleaner always notice the filling amount of dust in the dust container and replace the filled dust container with a new dust container when the dust container is completely filled.

FIG. 5A illustrates a canister-type vacuum cleaner 100. Vacuum cleaner 100 includes a floor cleaning unit 110 to which a brush is installed, a canister unit 120 and a hose assembly 130 extending between floor cleaning unit 110 and canister unit 120. Hose assembly 130 comprises a rigid wand and a flexible hose, and is pneumatically connected to a dust collecting compartment 140 (see FIG. 5B) of canister unit 120 through a suction hose connector 132.

Canister unit 120 mainly includes a hood 122, a cover 124 and a body 126. Hood 122 encloses dust collecting compartment 140 and is pivotally installed onto body 126 so as to open and close dust collecting compartment 140. Accordingly, hood 122 can be selectively positioned either in a closed position as illustrated in FIG. 5A or in an open position as illustrated in FIG. 5B. Hood 122 is also provided with an inlet opening 127 formed through hood 122 for receiving hose assembly 130. Hood 122 also is provided with a transparent window 128 for notifying the user of the dust collecting state. Cover 124 encloses a motor compartment (not shown) where an electric motor and a suction fan driven by the electric motor are positioned.

FIG. 5B schematically illustrates an internal structure of canister unit 120. In body 126 of canister unit 120, dust collecting compartment 140 is formed. In dust collecting compartment 140, a dust container 50 is accommodated. Dust container 50 includes a flat collar 52 made of strawboard and a receptacle portion 56 made of porous paper. Collar 52 is combined with receptacle portion 56 by glue. In the central portion of collar 52, an aperture 58 is formed. Aperture 58 is arranged so as to communicate with an air suction port 59 formed at the central portion of a dust container mounting portion 54. Dust container 50 is mounted on dust container mounting portion 54 by means of collar 52.

Meanwhile, on the upper portion of dust collecting compartment 140, an indicator device 10 for notifying the user of the operation state of vacuum cleaner 100 and the replacement time of dust container 50, is installed. Indicator device 10 is pneumatically connected with dust collecting compartment 140 through a nipple 40 extending between one end of indicator device 10 and dust collecting compartment 140. Indicator device 10 operates based on the pressure difference created between air suction port 59 and an outlet (not shown) formed in body 126 of canister unit 120.

FIGS. 6A, 6B & 7 illustrate in detail the internal structure of the conventional indicator device 10.

Indicator device 10 includes a transparent cylinder 12. At the open end of cylinder 12, an adjusting cap assembly 20 is inserted. Adjusting cap assembly 20 plays the role of adjusting the operating time of indicator device 10 by controlling the flow area of air. Adjusting cap assembly 20 includes a circular end cap 22 and a hollow fixing member 24. End cap 22 and fixing member 24 are tightly engaged to each other. At end cap 22, a semi-circular first opening 26 is formed. First opening 26 is a passageway for air at an atmosphere to flow in.

The other end of cylinder 12 is fixed by insertion into a nipple 40 installed at the upper portion of dust collecting compartment 140 (see FIG. 5B). Indicator device 10 communicates with dust collecting compartment 140 through nipple 40. Nipple 40 plays the role of an air transporting tube.

A cylindrical and hollow first plunger 30 and a cup-shaped second plunger 32 are slidablely and vertically positioned within cylinder 12. First plunger 30 and second plunger 32 are tightly engaged to each other in cylinder 12. First plunger 30 is provided with a plurality of second openings 31 formed at a side portion thereof and a third opening 33 formed at an open end thereof. Second openings 31 and third opening 33 become passageways for air at an atmosphere to flow in. The closed end of first plunger 30 is inserted into the other end opposite to the end of fixing member 24 into which end cap 22 is inserted.

Second plunger 32 is provided with a fourth opening 35 formed through the center thereof. Fourth opening 35 becomes a passageway for air at an atmosphere to flow in. At the outer periphery of second plunger 32, a plurality of recesses 34 are formed. O-shaped sealing rings 36 are disposed in recesses 34.

In second plunger 32, a cylindrical protrusion 37 for fixing a compression spring 38 is formed. Compression spring 38 is positioned between second plunger 32 and nipple 40. One end of compression spring 38 is fixed to protrusion 37 of second plunger 32, and the other end of compression spring 38 is fixed to one end of nipple 40. Compression spring 38 elastically supports first plunger 30 and second plunger 32. That is, first plunger 30 and second plunger 32 are elastically supported by compression spring 38, and are pushed toward the end of cylinder 12 where adjusting cap assembly 20 is positioned.

Meanwhile, first plunger 30 and second plunger 32 were colored by two colors, respectively, for notifying the user of vacuum cleaner 100 of the normal operation state and the completion state of the dust collection of vacuum cleaner 100. Preferably, first plunger 30 is colored in red and second plunger 32 is colored in green. By observing by naked eyes first plunger 30 and second plunger 32 through transparent window 128 installed at a hood 122 (see FIGS. 6A & 7), the user of the vacuum cleaner can notice the operating state of indicator device 10. Meanwhile, transparent window 128 can be substituted by a through groove 129 as illustrated in FIG. 6B, in order to reduce the manufacturing cost.

The operating process of the conventional indicator device 10 having the above-described structure will be briefly described below.

First, referring to FIGS. 5A & 5B, when a suction fan (not shown) positioned under cover 124 of canister unit 120 is driven by a motor (not shown), suction is achieved toward dust collecting compartment 140. As the result, air containing dust is sucked into dust collecting compartment 140 of canister unit 120 through floor cleaning unit 110 and hose assembly 130. Then, receptacle portion 56 of dust container 50 positioned in dust container 50 starts to expand. Since receptacle portion 56 of dust collecting compartment 140 is made of porous paper as described above, air containing dust that is sucked into dust container 50 is filtered while passing through receptacle portion 56, and the filtered air is exhausted out through an outlet (not shown) formed in body 126 of canister unit 120 and the motor. At this time, the granular dust cannot pass through receptacle portion 56, so is caught in dust container 50.

Meanwhile, when vacuum cleaner 100 operates normally as described above, indicator device 10 operates based on the pressure difference created between air suction port 59 and the outlet, and notifies the user of vacuum cleaner 100 of a normal operating state.

That is, if dust or other foreign substances do not completely fill receptacle portion 56 of dust container 50, the vacuum pressure created between dust container 50 and the motor in dust collecting compartment 140 is not high enough to overcome the predetermined elastic force of compression spring 38 in indicator device 10. As illustrated in FIGS. 6A & 6B, therefore, a special pressure difference is not created in cylinder 12, As the result, since first plunger 30 colored in red is not spaced from fixing member 24, second plunger 32 colored in green is exposed outward through transparent window 128 or through groove 129. The user observes the color by his naked eyes and notices that vacuum cleaner 100 is in a normal operating state.

On the contrary, when dust or other foreign substances completely fill receptacle portion 56 of dust container 50, the flow of air sucked into dust collecting compartment 140 of canister unit 120 from floor cleaning unit 110 of vacuum cleaner 100 through hose assembly 130, meets resistance. That is, when dust or other foreign substances completely fill receptacle portion 56 of dust container 50, air cannot easily pass through receptacle portion 56.

As a result, the vacuum degree created between receptacle portion 56 of dust container 50 positioned in dust collecting compartment 140 and the motor positioned in a motor compartment (not shown) is heightened. That is, a relatively high vacuum pressure is created in dust collecting compartment 140 when compared to that of vacuum cleaner 100 in a normal state.

Therefore, a relatively high vacuum pressure is created at the open end of nipple 40 in cylinder 12, which is pneumatically connected to dust collecting compartment 140 through nipple 40. As a result, air at an atmosphere acts on the outer surface of first plunger 30 through first opening 26 and hollow fixing member 24 in cylinder 12, overcomes the predetermined elastic force of compression spring 38, and pushes first plunger 30 toward the open end of nipple 40. Thus, first plunger 30 is pushed away from fixing member 24. At the same time, air is introduced through the separated space between fixing member 24 and first plunger, and pushes second plunger 32 exposed to the separated space. As a result, air at an atmosphere flows in second opening 31, third opening 33, fourth opening 35 and nipple 40 into dust collecting compartment 140.

Meanwhile, when integrally formed first plunger 30 and second plunger 32 move toward the open end of nipple 40, second plunger 32 colored in green passes by transparent window 128 or through groove 129 provided at hood 122 of vacuum cleaner 100, so first plunger 30 colored in red is exposed outward through transparent window 128 or through groove 129. The user of vacuum cleaner 100 observes by his naked eyes first plunger 30 through transparent window 128 or through groove 129 and can notice that it is time to replace dust container 50, which is filled with dust or other foreign substances, with a new dust container.

However, in the conventional indicator device 10 as described above, since a pressure difference created between air suction port 59 and the outlet in dust collecting compartment 140 exists, second plunger 32 and cylinder 12 should be sealed by using O-shaped sealing ring 36. O-shaped sealing ring 36 is positioned in recess 34 formed at the outer circumference of second plunger 32, which increases the cost of manufacture. Further, for the safe operation of visible indicator device 10, the pressure difference created between air suction port 59 and the outlet of dust collecting compartment 140 should be accurately maintained. Moreover, since first plunger 30 and second plunger 32 move reciprocatingly in cylinder 12, in indicator device 10 having the above described constitution, a frictional force is increased and the accuracy of indicator device 10 deteriorates. In addition, when through groove 129 is formed instead of transparent window 128 in order to reduce the manufacturing cost, impurities infiltrate into dust collecting compartment 140.

U.S. Pat. No. 4,060,050 issued to Sven Bertil Simonsson on Nov. 29, 1977, discloses a fill indicator of a vacuum cleaner developed to reduce the manufacturing cost thereof and increase the accuracy of the operation. Sven Bertil Simonsson's fill indicator includes a transparent cylinder and a chamber separated by a diaphragm. At one side of the cylinder, a spigot tube connected with an air suction port of a dust container, to which atmospheric pressure is applied, is installed. At one side wall of the chamber, a nipple connected with an outlet of the dust container, is installed. In the cylinder, a hollow piston and a journal longitudinally disposed through a side wall of the cylinder are positioned. The piston is rotatably journalled to the journal. In the chamber, a compression spring for elastically supporting the diaphragm is installed.

Sven Bertil Simonsson's fill indicator as briefly described above, notifies the user of the replacement time of the dust container by linearly reciprocating movement of the diaphragm and rotational movement of the piston based on the pressure difference created between the inlet and the outlet of the dust container.

However, Sven Bertil Simonsson's fill indicator could not completely solve the problems of the conventional indicator device 10. Sven Bertil Simonsson's fill indicator has a relatively more complicated internal constitution than that of the conventional indicator device 10. That is, Sven Bertil Simonsson's fill indicator employs a piston having a shaft and a spiral portion. The piston is installed to the diaphragm using a bolt and a nut. The journal for supporting one end of the piston is installed at one end of the cylinder. Therefore, for manufacturing each part constituting the internal structure as described above, minute machine processing is needed and the manufacturing cost thereof is high.

SUMMARY OF THE INVENTION

The present invention is contrived to solve the foregoing problems. It is an object of the present invention to provide a indicator device for a vacuum cleaner dust container having a simple internal structure and a low manufacturing cost.

In order to achieve the above object, the present invention provides an indicator device for visually denoting an amount of filled dust in a dust container of a vacuum cleaner, the indicator comprising:

an upper cap including a transparent upper surface exposed to the outside of the vacuum cleaner, and a side surface integrally formed with the upper surface and having a plurality of air suction ports;

an indicating means positioned in the upper cap for continuously displaying the amount of filled dust in the dust container by receiving a rotational force from an atmospheric air sucked through the air suction ports from an exterior of the indicator device;

a cylinder engaged at an end thereof with an open end of the upper cap, for rotatably supporting the indicating means;

an adjusting cap positioned in the cylinder for controlling a flow of the atmospheric air into the cylinder;

a connecting tube for pneumatically connecting an inner portion of the cylinder to a dust collecting compartment of the vacuum cleaner, where the dust container is positioned; and a supporting means positioned between the adjusting cap and the connecting tube in the cylinder, for elastically supporting the adjusting cap.

The upper cap is mounted to a hood of the vacuum cleaner by being inserted into a through groove formed through the hood.

The indicating means includes a disc-shaped colored film and a circular rotating member rotated by the atmospheric air, for rotatably supporting the colored film. One surface of the colored film is separated by 3×N (N is an integer) times and is colored in predetermined colors. Preferably, the colors are three primary colors of light of red, green and blue. Preferably, the colors are three primary colors of red, yellow and blue. A diameter of the colored film is smaller than an inner diameter of the upper cap, and the colored film includes a through hole formed through a center of the colored film for combining of the colored film with the rotating member.

The rotating member includes a disc which makes contact with a rear side of the colored film, and a circular rib which extends from and integrally formed with the disc, the circular rib includes a plurality of rotating wings extending radially outward at an outer periphery of the circular rib. The disc includes a circular protrusion protrusively formed at a center of the disc for being inserted into the through hole for combining the colored film with the rotating member.

The cylinder includes a circular rim portion formed at an end of the cylinder where the open end of the upper cap is combined, and a plurality of supporting ribs protrusively formed outward from the circular rim portion along an imaginary concentric circle. The circular rim portion defines a central opening for a flow of the atmospheric air, and includes a stage formed at an outer periphery of the circular rim portion for providing a seat for a combination with the open end of the upper cap. A diameter of the imaginary concentric circle is smaller than an inner diameter of the circular ribs and a length of the supporting ribs is longer than a longitudinal length of the circular ribs.

The adjusting cap includes a plurality of protrusive ribs formed at an outer periphery thereof, and a circular first fixing portion formed in the adjusting cap for fixing one end among free ends of the supporting means. The protrusive ribs include a plurality of air flowing holes formed through the protrusive ribs, for enabling a flow of the atmospheric air.

The connecting tube includes a circular second fixing portion formed at one end of the connecting tube, for fixing the other end of the supporting means fixed to the first fixing portion through the one end of the supporting means.

As described above, in the indicator device according to the present invention, the internal structure is simplified by replacement the adjusting cap assembly, the first plunger and the second plunger employed in the conventional indicator device, with the upper cap, the colored film and the rotating member having simple structures. Accordingly, the effect of lowering the manufacturing cost of the indicator device can be obtained. Further, the frictional problem which has been indicated as a defect in the conventional indicator device can be solved and the accuracy of the vacuum cleaner's operation is largely increased.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Figure 1:
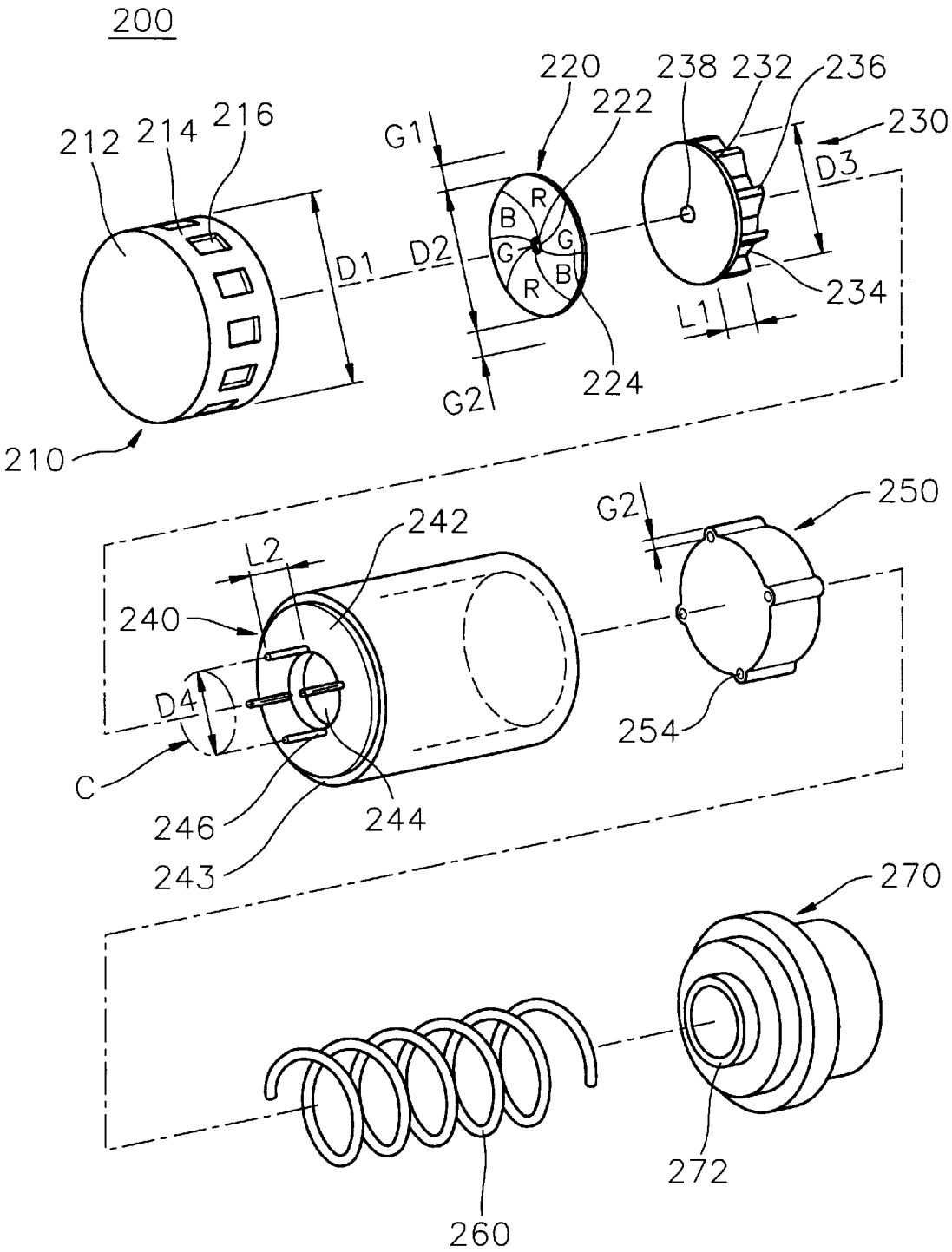
FIG. 1 is an exploded perspective view of an indicator device for a vacuum cleaner dust container according to a preferred embodiment of the present invention.
Figure 2:
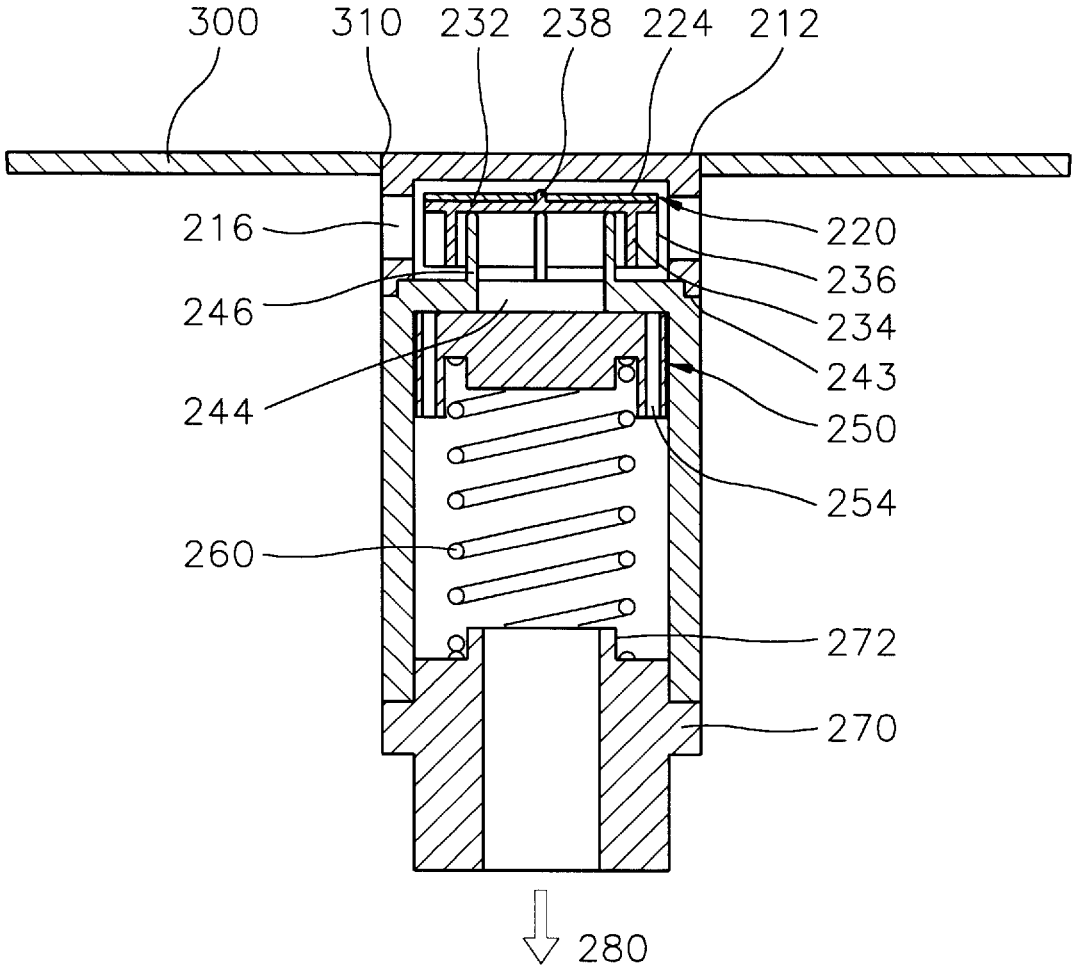
FIG. 2 is a longitudinal cross-sectional view of the indicator device illustrated in FIG. 1 for showing an installed state of the indicator device in a mounting groove formed in a hood of a vacuum cleaner.
Figure 3:
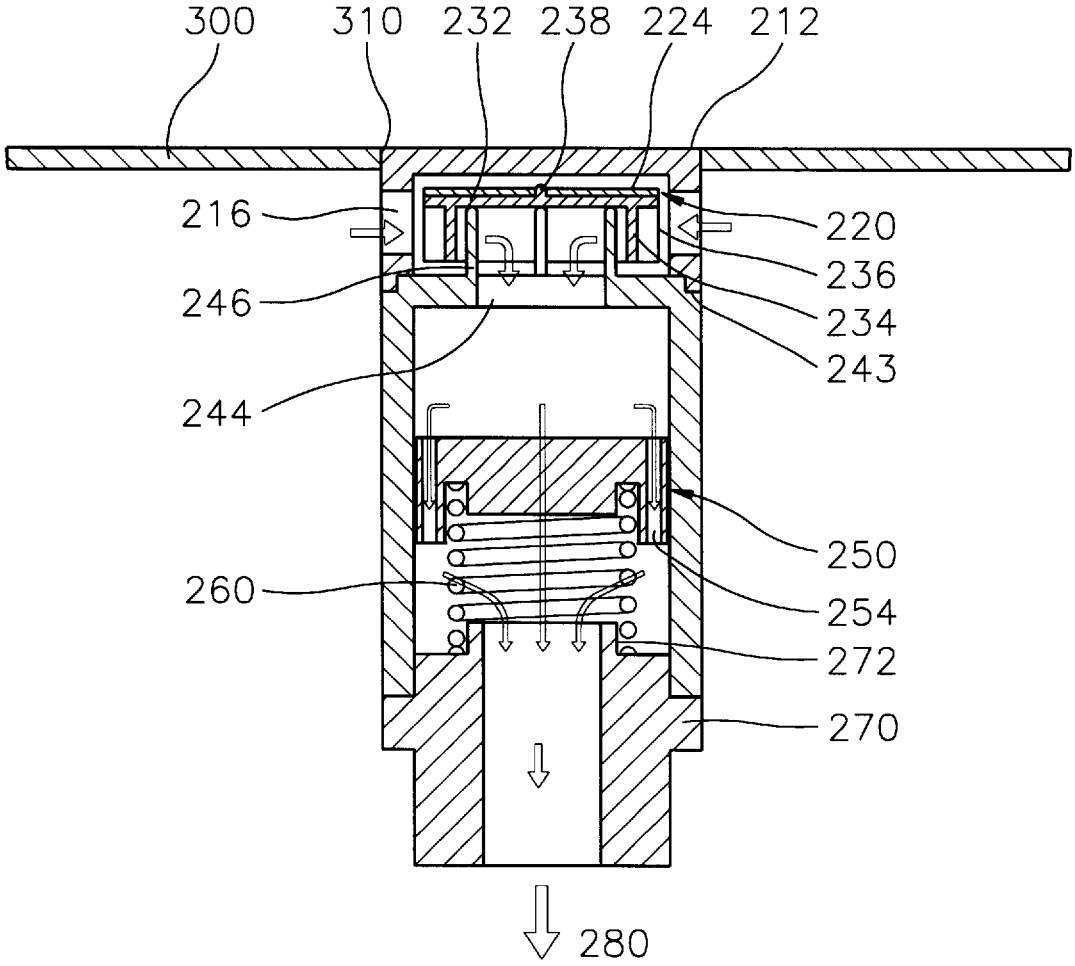
FIG. 3 is a longitudinal cross-sectional view of the indicator device illustrated in FIG. 2 for showing an operating state thereof.

Hereinafter, the preferred embodiment of the present invention will be explained in more detail with reference to the accompanying drawings.

FIGS. 1 to 4B illustrate an indicator device 200 according to a preferred embodiment of the present invention. First, referring to FIGS. 1 & 2, indicator device 200 includes a circular upper cap 210, a disc-shaped colored film 220, a circular rotating member 230, a hollow cylinder 240, a circular adjusting cap 250, a compression spring 260 and a connecting tube 270.

Upper cap 210 includes a transparent upper surface 212 exposed outward and a side surface 214 integrally formed with upper surface 212. A plurality of air suction ports 216 are formed at side surface 214. Air suction ports 216 are air passageways for the flow of air at an atmosphere. The diameter $D_2$ of colored film 220 is smaller than the internal diameter $D_1$ of upper cap 210 so that colored film 220 can be positioned in upper cap 210. As a result, a first interval $G_1$ having a predetermined distance is formed between the outer periphery of colored film 220, which is inserted and positioned in upper cap 210 and the inner surface of upper cap 210. Within the first interval $G_1$, colored film 220 can advantageously rotate in upper cap 210.

Colored film 220 includes a through hole 222 at the center thereof for enabling combination with rotating member 230 positioned at the rear side of colored film 220. Segments 224 separated by 3×N (N is an integer) times are formed at a surface of colored film 220 facing upper cap 210. Predetermined color is given to each segment 224. Preferably, segments 224 can be colored in the three primary colors of light, that is, in red (R), blue (B) and green (G). Differently, segments 224 separated by 3×N (N is an integer) times, can be colored in the three primary colors, that is, in red, yellow and blue.

Thus formed colored film 220 is rotatably supported by rotating member 230. Colored film 220 rotates through receiving the rotational force from rotating member 230, and during the rotation, colored film 220 displays a predetermined mixed color obtained from segments 224 colored in the predetermined primary colors.

Figure 4A:
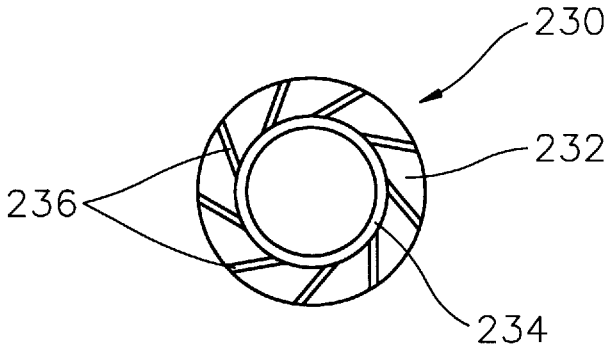
FIG. 4A is a bottom view of a rotating member illustrated in FIG. 1.

As illustrated in FIGS. 1 & 4A, rotating member 230 includes a disc 232 and a circular rib 234 integrally formed at the rear side of disc 232. Preferably, the diameter of disc 232 is the same as the diameter $D_2$ of colored film 220. A circular protrusion 238 is protrusively formed at the center of disc 232. Circular protrusion 238 is inserted into through hole 222 of colored film 220 for rotatably supporting colored film 220 on disc 232. A plurality of rotating wings 236 extending radially outward are spirally formed at the outer periphery of circular rib 234. Rotating wings 236 can be rotated by air at an atmosphere.

Cylinder 240 is provided with a circular rim portion 242 formed at one end thereof opposite to rotating member 230. A stage 243 is formed at the surrounding portion of circular rim portion 242. Thus formed stage 243 provides a combining seat for upper cap 210 during assembly of indicator device 200. Meanwhile, circular rim portion 242 defines a central opening 244. Central opening 244 becomes an air passageway for the flow of air.

On circular rim portion 242, a plurality of supporting ribs 246 are protrusively formed along an imaginary concentric circle (C). At this time, the diameter $D_4$ of the imaginary concentric circle (C) is smaller than the inner diameter $D_3$ of circular rib 234. Therefore, supporting ribs 246 can be positioned in circular rib 234. Meanwhile, length $L_2$ of supporting ribs 246 is longer than length $L_1$ of circular rib 234. Thus, rotating member 230 is supported apart from circular rim portion 242 of cylinder 240 and is not interrupted by circular rim portion 242 of cylinder 240 when rotating because air at an atmosphere acts on rotating wings 236.

In cylinder 240, an adjusting cap 250 and a compression spring 260 for elastically supporting adjusting cap 250 are positioned. Adjusting cap 250 functions as a valve. That is, adjusting cap 250 is dependently operated in dust collecting compartment 280 to adjust the flowing area of air based on the pressure difference created between an air suction port and an outlet formed on the body of the vacuum cleaner.

In cylinder 240, adjusting cap 250 is tightly positioned at the inner surface of circular rim portion 242 of cylinder 240. One side of adjusting cap 250 tightly positioned at the inner surface of circular rim portion 242 is exposed to the atmosphere through central opening 244 of cylinder 240 and is subjected to atmospheric pressure. A plurality of protrusive ribs 252 are integrally formed on the outer periphery of adjusting cap 250. Protrusive ribs 252 are formed along the circumference at a predetermined distance apart from each other and slidably make contact with the inner surface of cylinder 240 in cylinder 240. A predetermined second interval $G_2$ is formed between protrusive ribs 252 and the inner surface of cylinder 240. The second interval $G_2$ provides an air passageway for the flow of air.

Figure 4B:
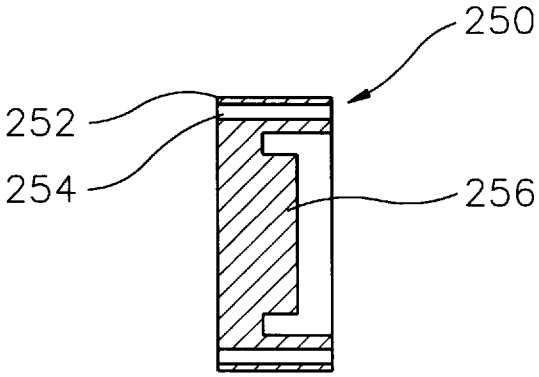
FIG. 4B is a longitudinal cross-sectional view of an adjusting cap illustrated in FIG. 1.

As illustrated in FIG. 4B, at protrusive ribs 252 of adjusting cap 250, air flowing holes 254 are respectively formed. A circular first fixing portion 256 for fixing and supporting compression spring 260 is formed at the inner portion of adjusting cap 250.

Referring to FIGS. 1 & 2 again, one end among the free ends of compression spring 260 is fixed to first fixing portion 256 (see FIG. 4B), and the other end of compression spring 260 is inserted to a circular second fixing portion 272 formed on a connecting tube 270. During the assembling process of indicator device 200, connecting tube 270 is inserted into the open end of cylinder 240 opposite to the end of cylinder 240 where circular rim portion 242 is formed.

Indicator device 200 having the above described constitution according to the present invention is installed in the vacuum cleaner through inserting upper cap 210 into a through groove 310 formed at a hood 300 of the vacuum cleaner. At this time, transparent upper surface 212 of upper cap 210 is exposed to the outside of vacuum cleaner 100 at through groove 310. The user of the vacuum cleaner 100 can observe the inner portion of indicator device 200 through transparent upper surface 212 exposed to the outside of vacuum cleaner 100, so can notice the operating state of the vacuum cleaner and the replacement time of a dust container (not shown) positioned in a dust collecting compartment 280.

The operation of indicator device 200 having the above described constitution according to a preferred embodiment of the present invention will be described as follows.

Figure 5A:
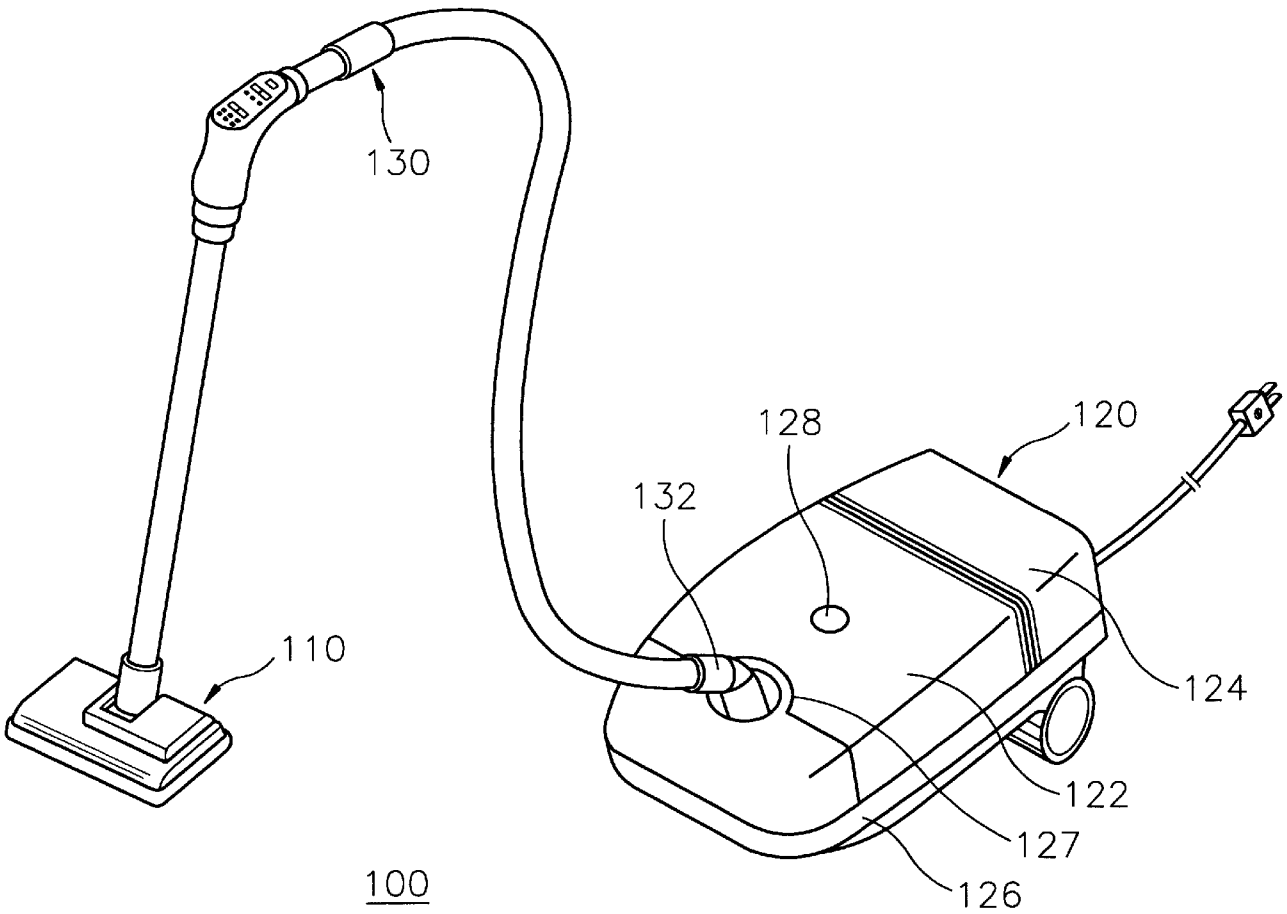
FIG. 5A (PRIOR ART)
FIG. 5A is a perspective view of a conventional canister-type vacuum cleaner.
Figure 5B:
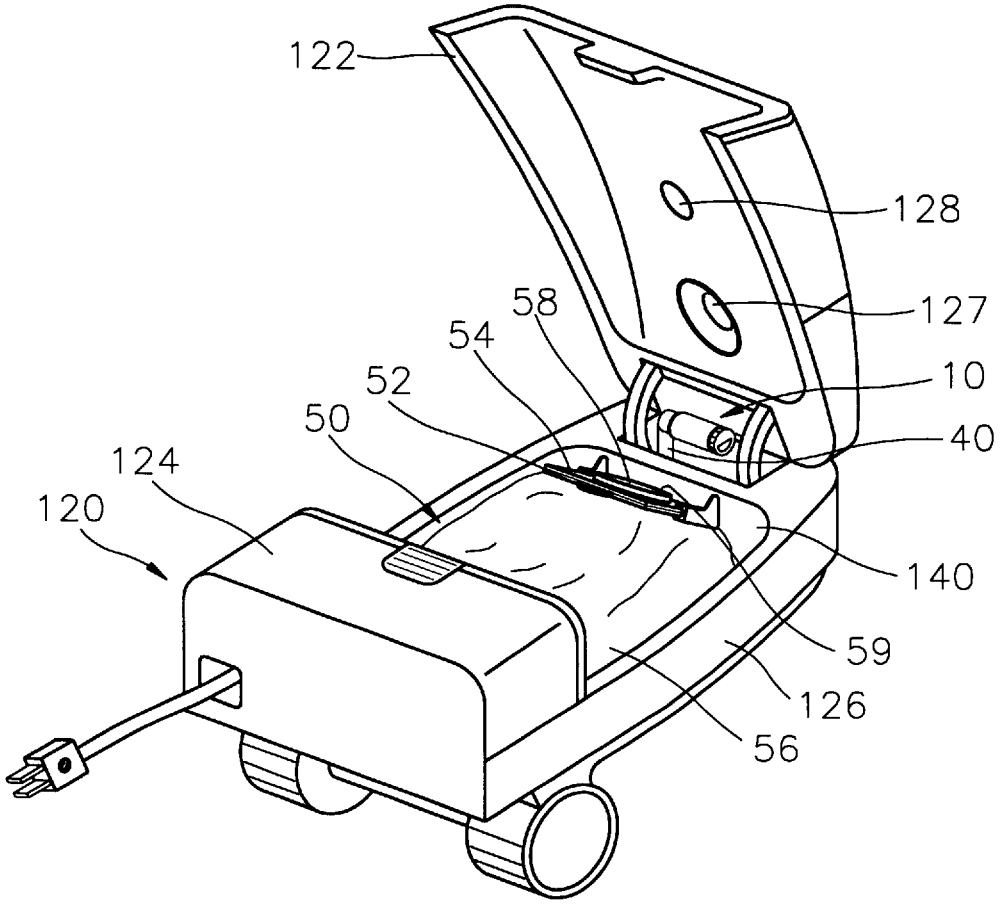
FIG. 5B (PRIOR ART)
FIG. 5B is a perspective view of a canister unit with its hood opened for showing the installed position of the indicator device installed in the canister unit of the vacuum cleaner illustrated in FIG. 5A.
Figure 6A:
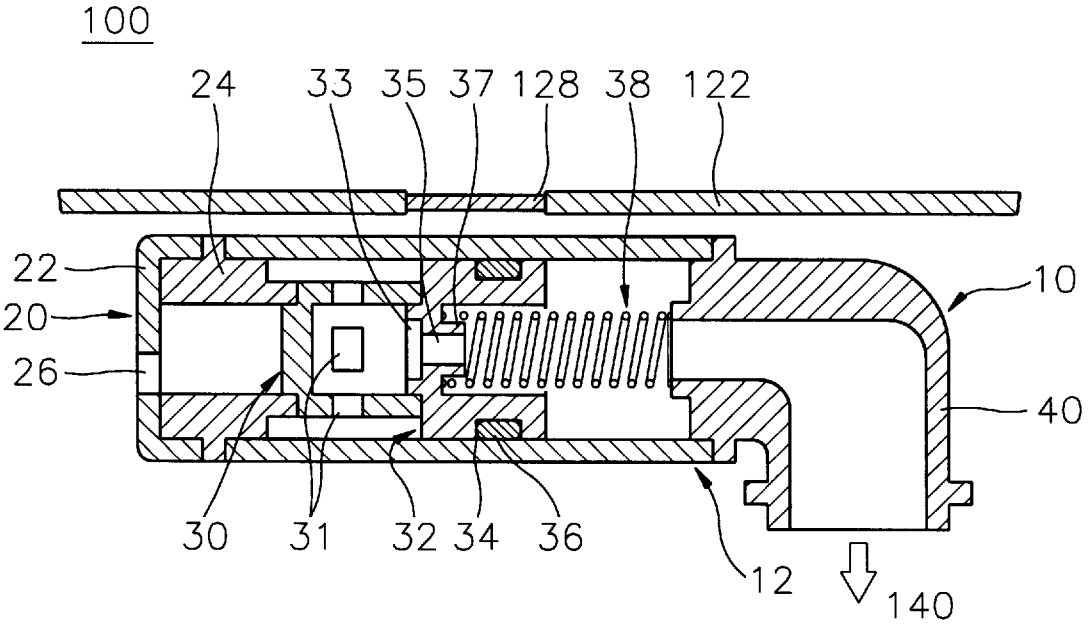
FIG. 6A (PRIOR ART)
FIG. 6A is a longitudinal cross-sectional view of the conventional indicator device installed in a vacuum cleaner having a transparent window on a hood.
Figure 6B:
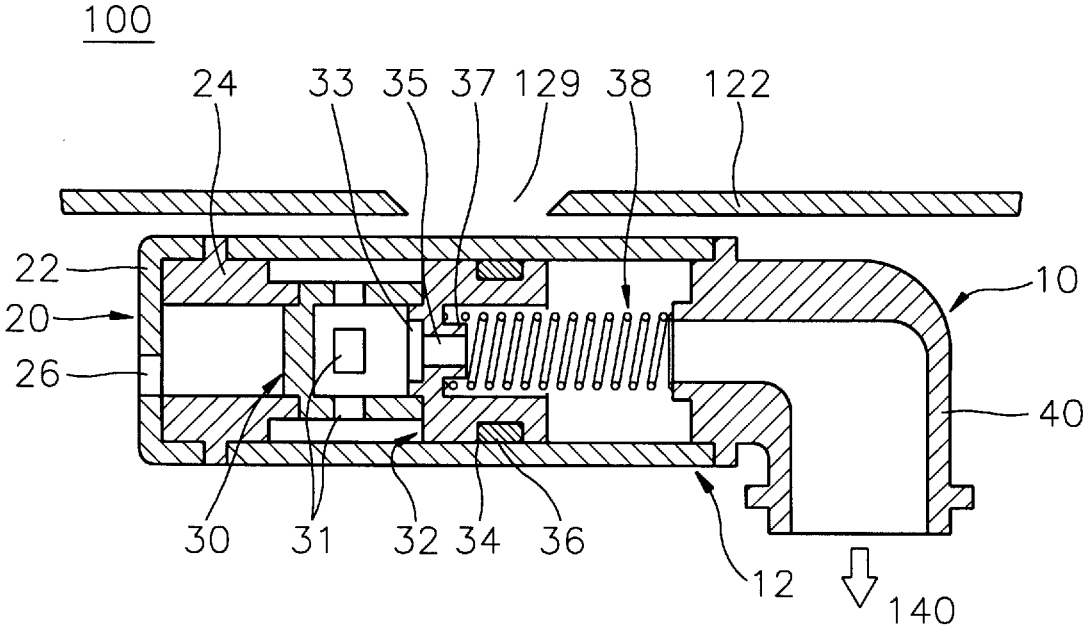
FIG. 6B (PRIOR ART)
FIG. 6B is a longitudinal cross-sectional view of the conventional indicator device installed in a vacuum cleaner having a through groove on a hood.
Figure 7:
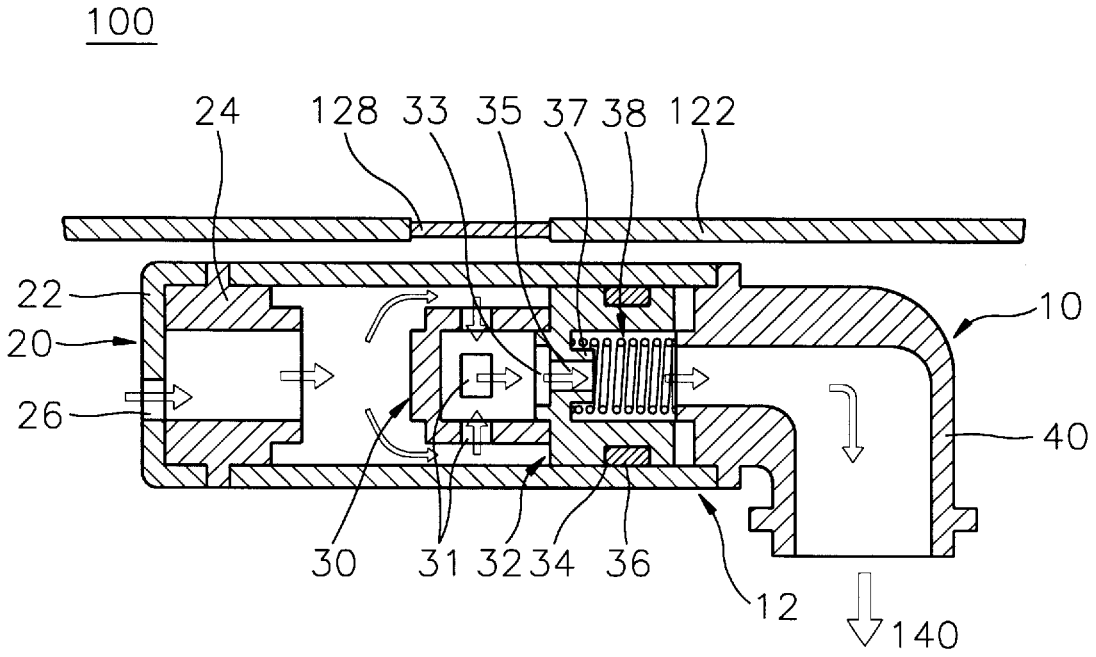
FIG. 7 (PRIOR ART)
FIG. 7 is a longitudinal cross-sectional view for showing the operating state of the indicator device illustrated in FIG. 6A.

Indicator device 200 of the present invention operates based on a vacuum pressure difference created between air suction port 59 (see FIG. 5B) and the outlet (not shown) of vacuum cleaner 100 (see FIGS. 5A & 5B), and denotes the operating state of vacuum cleaner 100 to the user.

Referring to FIG. 1, if dust or other foreign substances do not completely fill the dust container positioned in dust collecting compartment 280, the vacuum pressure created between the dust container and the motor (not shown) of a motor compartment is not sufficiently high to overcome the predetermined elastic force of compression spring 260 in indicator device 200. Accordingly, a special pressure change is not generated in cylinder 240 of indicator device 200.

As the result, adjusting cap 250 elastically supported by compression spring 260 in cylinder 240 is not separated from the inner surface of circular rim portion 242 of cylinder 240. That is, central opening 244 formed at circular rim portion 242 of cylinder 240 maintains a closed state at the upper surface of adjusting cap 250. Accordingly, air flowing through air suction ports 216 of upper cap 210 is not directed into cylinder 240, but remains in upper cap 210.

Therefore, rotating member 230 positioned in upper cap 210 does not rotate. Accordingly, colored film 220 supported on rotating member 230 also does not rotate. As a result, colored film 220 colored in red (R), green (G) and blue (B), reveals the primary colors through transparent upper surface 212 of upper cap 210. The user can notice that the vacuum cleaner operates normally by observing the colors by his naked eyes.

On the contrary, if dust or other foreign substances completely fill the dust container, air sucked into dust collecting compartment 280 of the vacuum cleaner receives resistance. That is, if dust or other foreign substances completely fill the dust container, air cannot easily pass through the dust container.

As a result, the vacuum degree created between the dust container positioned in dust collecting compartment 280 and the motor positioned in the motor compartment is heightened. That is, a relatively higher vacuum pressure than that created when the vacuum cleaner operates normally, is created in dust collecting compartment 280. Accordingly, a high vacuum pressure is created in cylinder 240, which is pneumatically connected with dust collecting compartment 280 through connecting tube 270. Therefore, a high vacuum pressure is created at the open end of connecting tube 270 in cylinder 240.

When a high vacuum pressure is created at the open end of connecting tube 270, the air flowing in through air suction ports 216 of upper cap 210 pushes the upper surface of adjusting cap 250, which closes central opening 244 of cylinder 240, and air is directed into cylinder 240. That is, the air flowing in through air suction ports 216 of upper cap 210 overcomes the spring force of compression spring 260 elastically supporting adjusting cap 250 and separates the upper surface of adjusting cap 250 from the inner surface of circular rim portion 242 by pushing adjusting cap 250 downward.

The atmospheric air which has passed through central opening 244 of cylinder 240 pushes the upper surface of adjusting cap 250 and passes through air flowing holes 254 formed in adjusting cap 250. Next, air which has passed through air flowing holes 254 is directed into dust collecting compartment 280 via connecting tube 270. As a result, the vacuum degree in dust collecting compartment 280 is lowered and accordingly, an over-loading of the motor can be prevented.

Meanwhile, colored film 220 and rotating member 230 positioned in upper cap 210 start to rotate as the atmospheric air flowing through air suction ports 216 is directed into cylinder 240 through central opening 244 of cylinder 240. That is, the atmospheric air flowing through air suction ports 216 pushes adjusting cap 250, which closes central opening 244, and separates adjusting cap 250 from the inner surface of circular rim portion 242. At the same time, air is sucked into cylinder 240 while it rotates rotating wings 236 of rotating member 230. As a result, rotating member 230 rotates and colored film 220 also rotates.

Now, since segments 224 at the upper surface of colored film 220 are separated by 3×N times and are colored in the three primary colors of light, that is, red (R), green (G) and blue (B), colored film 220 displays a certain color while rotating by rotating member 230.

If the amount of dust or other foreign substances caught in the dust container in dust collecting compartment 280 is small and the vacuum degree created between the dust container and the motor in the motor compartment is low, a low vacuum pressure is created at connecting tube 270 of indicator device 200. Accordingly, the amount of air directed into cylinder 244 does not become large, and colored film 220 and rotating member 230 rotate at low speed. During the low speed rotation, colored film 220 displays a certain mixed color of red (R), green (G) and blue (B), which is different from the primary colors colored in segments 224 of colored film 220.

As described above, when colored film 220 rotates with a certain color, the user of the vacuum cleaner can notice the filling state of dust or other foreign substances in the dust container by observing the color of colored film 220 through transparent upper surface 212 of upper cap 210 inserted into through hole 310 of hood 300.

In contrast, if the amount of dust or other foreign substances caught in the dust container in dust collecting compartment 280 is increased and the vacuum degree created between the dust container and the motor in the motor compartment is heightened, a high vacuum pressure is created at connecting tube 270 of indicator device 200. Accordingly, the amount of air directed into cylinder 240 becomes large, and colored film 220 and rotating member 230 rotate at high speed. During the high speed rotation, since colored film 220 is colored in the primary colors of light, that is, red (R), green (G) and blue (B), colored film 220 displays a white or a near-white color.

As described above, when colored film 220 rotates with a white or a near-white color, the user of the vacuum cleaner can notice that the dust container should be replaced because the dust container is completely filled with dust or other foreign substances, by observing the color of colored film 220 through transparent upper surface 212 of upper cap 210 inserted into through hole 310 of hood 300.

Meanwhile, if separated segments 224, which are separated by 3×N (N is an integer) times on the upper surface of colored film 220, are colored in the three primary colors of red, yellow and blue instead of the primary colors of light of red (R), green (G) and blue (B), when colored film 220 rotates at low speed, the upper surface of colored film 220 displays a mixed color of red, yellow and blue which differs from the primary colors, while when colored film 220 rotates at high speed a black or a near-black color is displayed. Accordingly, the user of the vacuum cleaner can notice that the dust container should be replaced by observing a black or a near-black color of colored film 220 through transparent upper surface 212 of upper cap 210 inserted into through hole 310 of hood 300.

As described above, indicator device 200 according to the present invention operates based on a vacuum pressure difference created between the air suction port and the outlet of the vacuum cleaner. The motor can be protected by preventing an over-loading of the motor and the user of the vacuum cleaner can notice the operating state of the vacuum cleaner and the replacement time of the dust container.

Indicator device 200 according to the present invention has a simplified internal structure by replacement the elements of adjusting cap assembly 20, fist plunger 30 and second plunger 32 employed in the conventional indicator device 10, with upper cap 210, colored film 220 and rotating member 230. Accordingly, the manufacturing cost of indicator device 200 is lower than that of the conventional indicator device. Further, the frictional problem of the conventional indicator device 10 is removed and the accuracy of the operation is increased.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An indicator device for visually denoting an amount of filled dust in a dust container of a vacuum cleaner, said indicator device comprising:

an upper cap including a transparent upper surface designed to be exposed to the outside of the vacuum cleaner, and a side surface integrally formed with the upper surface and having a plurality of air suction ports;

an indicating means positioned in said upper cap for continuously displaying the amount of filled dust in the dust container by receiving a rotational force from an atmospheric air sucked through said air suction ports from an exterior of said indicator device;

a cylinder engaged at an end thereof with an open end of said upper cap, for rotatably supporting said indicating means;

an adjusting cap positioned in said cylinder for controlling a flow of the atmospheric air into said cylinder;

a connecting tube for pneumatically connecting an inner portion of said cylinder to a dust collecting compartment of the vacuum cleaner, where the dust container is positioned; and a supporting means positioned between said adjusting cap and said connecting tube in said cylinder, for elastically supporting said adjusting cap.

2. An indicator device as claimed in claim 1, wherein said upper cap is designed to be mounted to a hood of the vacuum cleaner by being inserted into a through groove formed through the hood.

3. An indicator device as claimed in claim 1, wherein said indicating means includes a disc-shaped colored film and a circular rotating member rotated by the atmospheric air, for rotatably supporting said colored film.

4. An indicator device as claimed in claim 3, wherein one surface of said colored film is separated by 3×N (N is an integer) times and is colored in predetermined colors.

5. An indicator device as claimed in claim 4, wherein the colors are three primary colors of light of red, green and blue.

6. An indicator device as claimed in claim 4, wherein the colors are three primary colors of red, yellow and blue.

7. An indicator device as claimed in claim 3, wherein a diameter of said colored film is smaller than an inner diameter of said upper cap, and said colored film includes a through hole formed through a center of said colored film for combining of said colored film with said rotating member.

8. An indicator device as claimed in claim 7, wherein said rotating member includes a disc which makes contact with a rear side of said colored film, and a circular rib which extends from and is integrally formed with said disc, said circular rib includes a plurality of rotating wings extending radially outward at an outer periphery of said circular rib.

9. An indicator device as claimed in claim 8, wherein said disc includes a circular protrusion protrusively formed at a center of said disc for being inserted into said through hole for combining said colored film with said rotating member.

10. An indicator device as claimed in claim 8, wherein said cylinder includes a circular rim portion formed at an end of said cylinder where said open end of said upper cap is combined, and a plurality of supporting ribs protrusively formed outward from said circular rim portion along an imaginary concentric circle.

11. An indicator device as claimed in claim 10, wherein said circular rim portion defines a central opening for a flow of the atmospheric air, and includes a stage formed at an outer periphery of said circular rim portion for providing a seat for a combination with said open end of said upper cap.

12. An indicator device as claimed in claim 10, wherein a diameter of the imaginary concentric circle is smaller than an inner diameter of said circular rib and a length of said supporting ribs is longer than a longitudinal length of said circular rib.

13. An indicator device as claimed in claim 1, wherein said adjusting cap includes a plurality of protrusive ribs formed at an outer periphery thereof, and a circular first fixing portion formed in said adjusting cap for fixing one end among free ends of said supporting means.

14. An indicator device as claimed in claim 13, wherein said protrusive ribs include a plurality of air flowing holes formed through said protrusive ribs, for enabling a flow of the atmospheric air.

15. An indicator device as claimed in claim 13, wherein said connecting tube includes a circular second fixing portion formed at a first end of said connecting tube, for fixing a first end of said supporting means fixed to said circular first fixing portion through the one end of said supporting means.

16. An indicator device for visually denoting an amount of filled dust in a dust container of a vacuum cleaner, said indicator device comprising:

an upper cap including a transparent upper surface designed to be exposed to the outside of the vacuum cleaner, and a side surface integrally formed with the upper surface and having a plurality of air suction ports;

an indicating means positioned in said upper cap for continuously displaying the amount of filled dust in the dust container by receiving a rotational force from an atmospheric air sucked through said air suction ports from an exterior of said indicator device, said indicating means including a disc-shaped colored film and a circular rotating member rotated by the atmospheric air, for rotatably supporting said colored film, in which one surface of said colored film is separated by 3×N (N is an integer) times and is colored in predetermined colors;

a cylinder engaged at an end thereof with an open end of said upper cap, for rotatably supporting said indicating means, said cylinder including a circular rim portion formed at an end of said cylinder where said open end of said upper cap is combined, and a plurality of supporting ribs protrusively formed outward from said circular rim portion along an imaginary concentric circle;

an adjusting cap positioned in said cylinder for controlling a flow of the atmospheric air into said cylinder, said adjusting cap including a plurality of protrusive ribs formed at an outer periphery thereof, and a circular first fixing portion formed in said adjusting cap;

a connecting tube for pneumatically connecting an inner portion of said cylinder to a dust collecting compartment of the vacuum cleaner, where the dust container is positioned; and a supporting means positioned between said adjusting cap and said connecting tube in said cylinder, for elastically supporting said adjusting cap, said circular first fixing portion fixing one end among free ends of said supporting means.

17. An indicator device as claimed in claim 16, wherein said upper cap is designed to be mounted to a hood of the vacuum cleaner by being inserted into a through groove formed through the hood.

18. An indicator device as claimed in claim 16, wherein the colors are three primary colors of light of red, green and blue.

19. An indicator device as claimed in claim 16, wherein the colors are three primary colors of red, yellow and blue.

20. An indicator device as claimed in claim 16, wherein a diameter of said colored film is smaller than an inner diameter of said upper cap, and said colored film includes a through hole formed through a center of said colored film for combining of said colored film with said rotating member.

21. An indicator device as claimed in claim 20, wherein said rotating member includes a disc which makes contact with a rear side of said colored film, and a circular rib which extends from and is integrally formed with said disc, said circular rib includes a plurality of rotating wings extending radially outward at an outer periphery of said circular rib.

22. An indicator device as claimed in claim 21, wherein said disc includes a circular protrusion protrusively formed at a center of said disc for being inserted into said through hole for combining said colored film with said rotating member.

23. An indicator device as claimed in claim 21, wherein a diameter of the imaginary concentric circle is smaller than an inner diameter of said circular rib and a length of said supporting ribs is longer than a longitudinal length of said circular rib.

24. An indicator device as claimed in claim 16, wherein said circular rim portion defines a central opening for a flow of the atmospheric air, and includes a stage formed at an outer periphery of said circular rim portion for providing a seat for a combination with said open end of said upper cap.

25. An indicator device as claimed in claim 16, wherein said protrusive ribs include a plurality of air flowing holes formed through said protrusive ribs, for enabling a flow of the atmospheric air.

26. An indicator device as claimed in claim 16, wherein said connecting tube includes a circular second fixing portion formed at one end of said connecting tube, for fixing the other end of said supporting means fixed to said first fixing portion through the one end of said supporting means.

* * * * *